US006249268B1

(12) United States Patent
Tachibana et al.

(10) Patent No.: US 6,249,268 B1
(45) Date of Patent: Jun. 19, 2001

(54) IMAGE DISPLAY APPARATUS

(75) Inventors: Miyuki Tachibana; Kazuo Yoshioka, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/177,513

(22) Filed: Oct. 23, 1998

(30) Foreign Application Priority Data

Jun. 26, 1998 (JP) ..... 10-181240

(51) Int. Cl.[7] ..... G09G 5/00

(52) U.S. Cl. ..... 345/89; 345/214; 345/147; 345/204

(58) Field of Search ..... 345/60, 63, 64, 345/204, 214, 212, 89, 147

(56) References Cited

U.S. PATENT DOCUMENTS

| | | | | |
|---|---|---|---|---|
| 4,912,334 | * | 3/1990 | Akodes | 345/89 |
| 5,337,068 | * | 8/1994 | Stewart et al. | 345/88 |
| 6,037,917 | | 2/2000 | Kawakami | 345/63 |
| 6,040,812 | * | 3/2000 | Lewis | 345/89 |

FOREIGN PATENT DOCUMENTS

| | | |
|---|---|---|
| 702347 | 3/1996 | (EP) . |
| 755042 | 1/1997 | (EP) . |
| 833299 | 4/1998 | (EP) . |
| 5-181430 | 7/1993 | (JP) . |
| 6-259033 | 9/1994 | (JP) . |
| 9-244575 | 9/1997 | (JP) . |
| 10-124004 | 5/1998 | (JP) . |
| 10-187094 | 7/1998 | (JP) . |
| 10-274961 | 10/1998 | (JP) . |
| 11-352932 | 12/1999 | (JP) . |

* cited by examiner

*Primary Examiner*—Amare Mengistu

(57) ABSTRACT

An image display apparatus including a display unit 20 having a plurality of pixels, lighting controlling means 5 and 16*a* for controlling a time for lighting the pixels on the display unit 20 within a predetermined time in order to display a multiple-gradation image, and correcting means 4 and 5 for correcting the lighting time controlled by the lighting controlling means 5 and 16*a*. Even when characteristic dispersion per pixel of the display unit 20 is large, characteristic dispersion between image display apparatuses can be restrained.

13 Claims, 7 Drawing Sheets

IMAGE DISPLAY APPARATUS

BACKGROUND OF THE INVENTION

The present invention relates to an image display apparatus which uses a display panel or the like formed by PDP (Plasma Display Panel) or LED (Light Emitting Diode), and particularly relates to improvement in controlling a lighting time of pixels within a predetermined time in order to display an image with multiple gradations.

In recent years, an image display apparatus of a flat panel type using PDP or LED has been put into practice, and such a display has been utilized in various fields.

Such an image display apparatus is generally arranged so that an image is displayed with multiple gradations by controlling a time for lighting respective pixels within a predetermined time (1 field period).

FIG. 1 is a block diagram showing an example of the arrangement of such an image display apparatus disclosed in Japanese Patent Application laid-Open No. 6-259033 (1994). This conventional image display apparatus uses PDP, and it includes an A/D converting circuit 12, frame memories 13 and 14 and a bit selecting circuit 15. The A/D converting circuit 12 converts a video signal inputted to a video signal input terminal 11 into a digital signal. The video signal, which has been converted into the digital signal by the A/D converting circuit 12, as image data is written alternately into the frame memories 13 and 14 per predetermined period (for example, 1/30 sec or 1/60 see which is one frame period). The bit selecting circuit 15 selects image data of pixels (bit) to be displayed from the image data read out alternately from the frame memories 13 and It.

Above conventional image display apparatus also includes a synchronizing signal separating circuit 17, a timing signal output circuit 18, an X driver 16 and a Y driver 19. The synchronizing signal separating circuit 17 separates a synchronizing signal (for example, a horizontal synchronizing signal and vertical synchronizing signal) from the video signal inputted into the video signal input terminal 11. The timing signal output circuit 18 supplies a timing signal to the A/D converting circuit 12, the frame memories 13 and 14, the bit selecting circuit 15 and the other portions based on the synchronizing signal separated by the synchronizing signal separating circuit 17. The X driver 16 is supplied with the image data selected by the bit selecting circuit 15 and the timing signal from the timing signal output circuit 18, and outputs pulse signals for deleting, writing, addressing, scanning, sustaining (discharge sustaining), etc. to a matrix-type display panel 20 which is a PDP. The Y driver 19 is supplied with the timing signal from the timing signal output circuit 18, and outputs a pulse signal for scanning to the display panel 20.

The following describes an operation of the image display apparatus having such an arrangement.

A video signal inputted to the video signal input terminal 11 is converted into a digital signal by the A/D converting circuit 12 so that odd frames and even frames are written as image data alternately into the frame memories 13 and 14 per predetermined period. The bit selecting circuit 15 reads out the image data alternately from the frame memories 13 and 14, and selects the image data of pixels to be displayed so as to supply it to the X driver 16.

The X driver 16 outputs respective pulse signals for deleting, writing, addressing, scanning, sustaining, etc. based on the image data from the bit selecting circuit 15 and a timing signal from the timing signal output circuit 18, and performs matrix display on the display panel 20 according to the pulse signal for scanning outputted by the Y driver 19.

For example, in the case of 8-bit gradation (256 gradations) display, as shown in FIG. 2, as for the pixels of the matrix display panel 20, one field period as one picture display period is divided into eight subfield periods SFI, SF2, . . . SFt8, and the divided subfield periods SF1, SF2, . . . SF8 are further divided respectively into an addressing periods AP and display periods SP. The respective subfield periods SFl, SF2, ... SF8 are weighted in proportion of 1:2:4: . . . :128, and when a display pulse number for weight per unit (sustain pulse: pulse for sustaining plasma discharge) is two, for example, respective display pulse numbers of the subfield periods SF1, SF2, . . . SF8 becomes two, four, eight, . . . 256.

Since the display pulse number is approximately in proportion to luminous brightness of the pixels, when subfield periods (for example, SF1, SF3 and SF5) are selected from the eight subfield periods SF1, SF2, . . . SF8 according to the luminous brightness, the pixels can be lit for a time while gradation display (for example, the eighth-gradation display in the 256-gradation display) can be obtained according to the luminous brightness in the 256 gradations. Here, the addressing periods AP of the respective subfield period SF1, SF2 . . . SF8 are constant (for example, 1.5 ms) regardless of the subfield periods, and are determined by a type of the display panel 20. In the addressing period AP of each subfield period, writing is performed on the whole surface (all pixels) of the display panel 20, and deleting discharge takes places according to image data and thus addressing is performed. In the display period SP next to the addressing period AP, as mentioned above, the pixels are lit or turned off for the time while each subfield period is weighted according to a display pulse number (sustain frequency).

This conventional image display apparatus controls the time for lighting the pixels within a predetermined period (for example, 1/30 sec or 1/60 sec which is one field period) according to a display pulses number (sustain frequency) so as to display an image with multiple gradations.

FIG. 3 is a block diagram showing a principle of an image display apparatus disclosed in Japanese Patent Application Laid-Open No. 9-244575 (1997).

This conventional image display apparatus includes a matrix type display panel 31 which is PDP, brightness setting means 33, display rate detecting means 32 and translation table selecting means 34. The brightness setting means 33 converting a video signal into a digital signal so as to generate image data, and sets brightness per pixel (bit) of the image data. The display rate detecting means 32 detects a display rate DR (the ratio of the sum of values obtained by multiplying a number of pixels on the whole picture to be lit by the lighting time to the maximum value) on one display picture of the display panel 31 from the image data. The translation table selecting means 34 selects a translation table for correcting and translating the brightness set by the brightness setting means 33 according to the display rate DR detected by the display rate detecting means 32, and corrects and translates the brightness so that the power consumption of the display panel 31 does not become excessive.

The translation table of the translation table selecting means 31 is made based on the display rate DR which is previously measured so that the power consumption of the display panel 31 does not become excessive.

This conventional image display apparatus further includes sustain frequency determining means 35 for determining a display pulse number (sustain frequency) according to the brightness which has been corrected and translated by the translation table selecting means 34 so as to supply the display pulse number to the display panel 31.

In the conventional image display apparatus having such an arrangement, the brightness per the pixels of the image data set by the brightness setting means 33 is corrected by the translation table selecting means 34 based on the display rate DR detected by the display rate detecting means 32 so that the power consumption of the display panel 31 does not become excessive. Then, the sustain frequency determining means 35 determines a display pulse number (sustain frequency) according to the corrected brightness so as to supply the display pulse number to the display panel 31. The display panel 31 controls the time for lighting the pixels within a predetermined period according to the display pulse number and displays an image with multiple gradations. The other operations are the same as those in the aforementioned image display apparatus shown in FIG. 1.

In the conventional image display apparatus shown in FIG. 3, when a judgment is made that the power consumption of the display unit (display panel 31) becomes larger based on contents of the displayed image (display rate DR), the sustain frequency is reduced so that the power consumption of the image display apparatus does not become excessive.

Meanwhile, in the display unit such as a display panel formed by PIOP or LED, characteristic dispersion of the display device is large, and as a result, characteristic dispersion of the image display apparatus, such as the power consumption dispersion becomes larger.

In the conventional image display apparatus shown in FIG. 3, control can be made so that the power consumption of the image display apparatus does not become excessive, but the power consumption dispersion of the image display apparatus due to the characteristic dispersion of the display device in the display unit cannot be restrained.

In addition, a refresh rate of a video output signal of a personal computer or the like, namely, a vertical synchronizing signal frequency has been higher from the viewpoint of human engineering, and various frequencies of not less than 60 Hz has been used.

In an image display apparatus using PDP or the like, a number of pictures according to the refresh rate are generated, namely, in the case of 60 Hz, 60 pictures are generated, and in the case of 75 Hz, 75 pictures are generated and they are displayed for one sec. Since the display rate of one picture is the same in the cases of 60 Hz and 75 Hz (the display data are the same), for example, in the case where, the display rate for 1 sec is considered, the display rate is larger in the case of 75 Hz than in the case of 60 Hz. As a result, even when the same display data are displayed the power consumption becomes larger as the refresh rate is higher.

BRIEF SUMMARY OF THE INVENTION

The present invention is devised with such points in view, it is an object of the present invention to provide an image display apparatus which can restrain characteristic dispersion between image display apparatuses even in the case where characteristic dispersion of a display device in a display unit is large.

From fifth through seventh aspects, it is an object of the invention to provide an image display apparatus which can restrain a change in power consumption due to a refresh rate of an input signal.

An image display apparatus according to the first aspect includes a display unit having a plurality of pixels, lighting controlling means for controlling a time for lighting the pixels within a predetermined time in order to display a multiple-gradation image, and correcting means for correcting the lighting time controlled by the lighting controlling means.

The image display apparatus according to the second aspect further includes storing means for storing dispersion information representing characteristic dispersion of a display device of the display unit, and the correcting means corrects the lighting time controlled by the lighting controlling means based on the dispersion information stored in the storing means.

In the image display apparatus according to the third aspect, the dispersion information stored in the storing means is information relating to dispersion of power consumption of the display device.

In the image display apparatus according to the fourth aspect, the dispersion information stored in the storing means is information relating to dispersion of luminous brightness of the display device.

An image display apparatus according to the fifth aspect includes a display unit having a plurality of pixels, lighting controlling means for controlling a time for lighting the pixels within a predetermined time in order to display a multiple-gradation image, detecting means for detecting a refresh rate of a video signal to be displayed, and correcting means for correcting the lighting time controlled by the lighting controlling means based on the refresh rate detected by the detecting means.

Here, in the image display apparatus according to each aspect, the display unit is a plasma display panel, or a display panel composed of light-emitting diode.

The above and further objects and features of the invention will more fully be apparent from the following detailed description with accompanying drawings.

DESCRIPTION OF THE PREFERRED EMBODIMENTS

The following describes embodiments of the present invention on reference to the drawings.

[First Embodiment]

Figure 4:
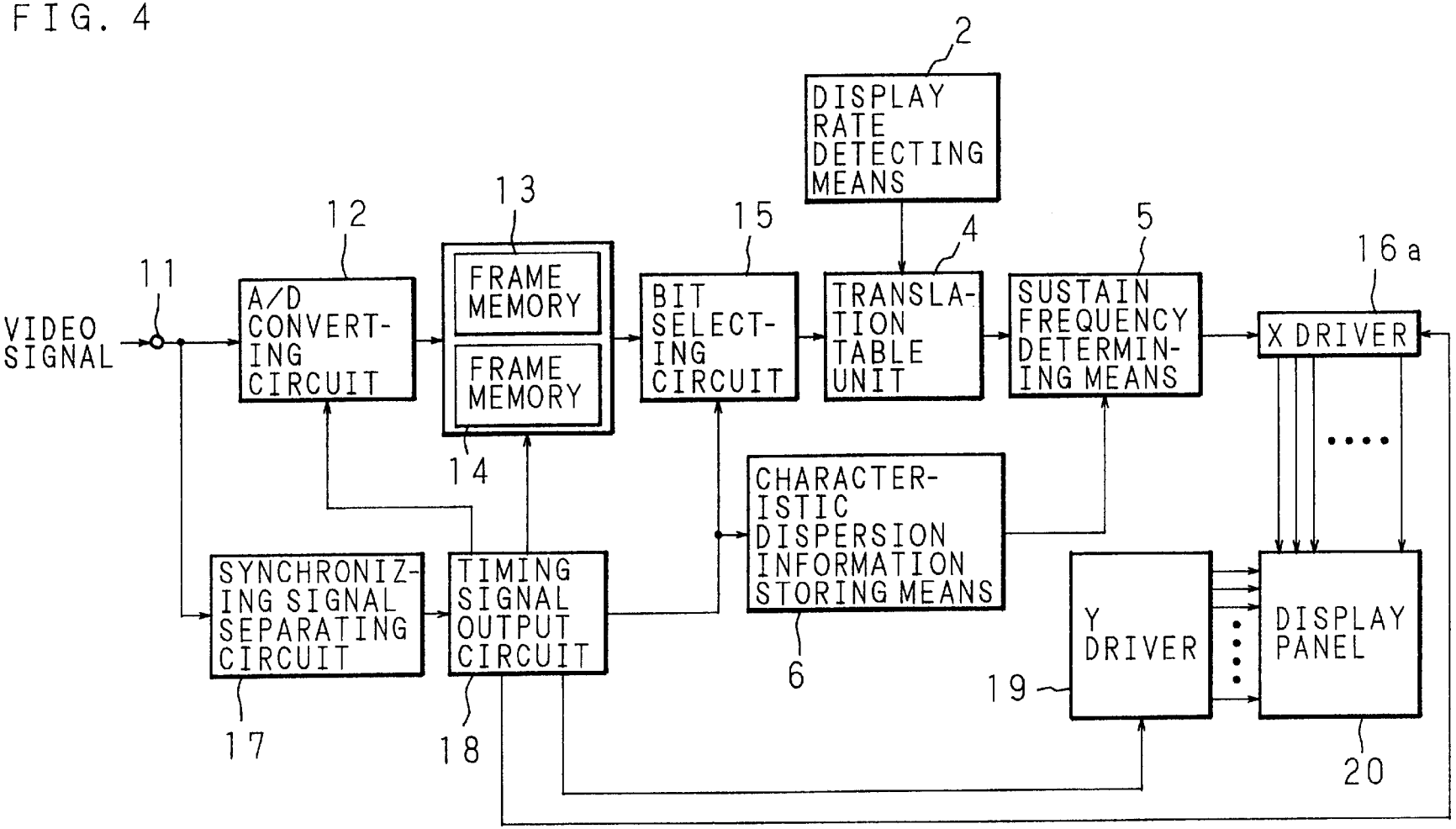
FIG. 4 is a block diagram showing an arrangement of an image display apparatus according to a first embodiment of the present invention.

FIG. 4 is a block diagram showing the arrangement of the image display apparatus according to the first embodiment of the present invention.

The image display apparatus according to the first embodiment of the present invention includes a matrix type display panel 20 which is PDP, an A/D converting circuit 12, frame memories 13 and 14, a bit selecting circuit 1.5. The A/D converting circuit 12 converts a video signal inputted to a video signal input terminal II into a digital signal. The video signal which is converted into the digital signal by the A/D converting circuit is written as image data alternately into the frame memories 13 and 14 per predetermined period (for example, 1/30 sec or 1/60sec which is one frame period). The bit selecting circuit 15 selects image data of pixels (bit) to be displayed from the image data read out alternately from the frame memories 13 and 14 and outputs the image data.

The image display apparatus according to the first embodiment of the present invention further includes display rate detecting means 2 and a translation table unit 4. The display rate detecting means 2 detects a display rate DR (the ratio of the sum of values obtained by multiplying a number of pixels on the whole picture to be lit by the lighting time to the maximum value) on one display picture of the display panel 20 from the image data. The translation table unit 4 selects a translation table for correcting and translating brightness of the image data outputted by the bit selecting circuit 15 according to the display rate DR detected by the display rate detecting means 2 so that power consumption of the display panel 20 does not become excessive, and corrects and translates the brightness. The translation table unit 4 is made based on the display rate DR which is previously measured so that the power consumption of the display panel 20 does not become excessive.

The image display apparatus according to the first embodiment of the present invention further includes characteristic dispersion information storing means 6 (storing means) and sustain frequency determining means (lighting controlling means and correcting means). The characteristic dispersion information storing means 6 stores dispersion information representing dispersion of power consumption of a display device which is characteristic dispersion per individual display panel 20 previously measured. The sustain frequency determining means 5 determines and outputs a display pulse number (sustain frequency) per pixel according to the brightness, which has been corrected and translated by the translation table unit 4, and the dispersion information about the power consumption stored in the characteristic dispersion information storing means 6.

The dispersion information about the power consumption per pixel is generated as follows and is stored in the characteristic dispersion information storing means 6. For example, just when production and assembly are completed, this image display apparatus is driven by a standard sustain frequency $f_0$, and power consumption $P_1$ of the display panel 20 at this time is measured, and the measured power consumption $P_1$ is compared with predetermined power consumption $P_0$. When the measured power consumption $P_1$ is larger than the predetermined power consumption $P_0$, the sustain frequency of that pixel is reduced so that sustain frequency $f_1$ in which the measured power consumption $P_1$ coincides with the predetermined power consumption $P_0$ is obtained. Moreover, when the measured power consumption $P_1$ is smaller than the predetermined power consumption $P_0$, the sustain frequency of that pixel is increased as the need arises so that sustain frequency $f_1$* in which the measured power consumption $P_1$ coincides with the predetermined power consumption $P_0$ is obtained.

As a result, information per obtained pixel relating to $\Delta f=f_1$ (or $f_1$*)$-f_0$, for example, correction factor $k=f_1$ (or $f_1$*)$/f_0$ is calculated, and it is stored as the dispersion information about the power consumption of the display device into the characteristic dispersion information storing means 6.

The image display apparatus according to the first embodiment of the present invention further includes a synchronizing signal separating circuit 17, a timing signal output circuit 18, an X driver 16*a* (lighting controlling means) and a Y driver 19. The synchronizing signal separating circuit 17 separates a synchronizing signal (for example, horizontal synchronizing signal and vertical synchronizing signal) from the video signal inputted to the video signal input terminal 11. The timing signal output circuit 18 supplies a timing signal to the A/D converting circuit 12, the frame memories 13 and 14, the bit selecting circuit 15, the characteristic dispersion information storing means 6 and the other portions based on the synchronizing signal separated by the synchronizing signal separating circuit 17. The X driver 16*a* is supplied with the sustain frequency, which was determined and outputted by the sustain frequency determining means 5, and the timing signal from the timing signal output circuit 18, and outputs pulse signals for deleting, writing, addressing, scanning, sustaining (discharge sustaining), etc. to the display panel 20. The Y driver 19 is supplied with the timing signal from the timing signal output circuit 18, and outputs the pulse signal for scanning to the display panel 20.

The following describes an operation of the image display apparatus according to the first embodiment of the present invention having the above arrangement.

A video signal inputted to the video signal input terminal 11 is converted into a digital signal by the A/D converting circuit 12, and odd frames and even frames are written as image data alternately into the frame memories 13 and 14 per predetermined period. The hit selecting circuit 15 reads out image data alternately from the frame memories 13 and 14, and selects image data of pixels to be displayed so as to supply the selected image data to the translation table unit 4.

The translation table unit 4 selects a translation table for correcting and translating brightness of the image data according to the display rate DR detected by the display rate detecting means 2 so that power consumption of the display panel 20 does not become excessive, and corrects and translates the given brightness so as to output the corrected brightness.

The sustain frequency determining means 5 determines and outputs a display pulse number (sustain frequency) of pixels to be displayed based on the brightness of the pixels to be displayed, which was outputted by the translation table unit 4, and the correction factor k of the pixels to be displayed, which is stored in the characteristic dispersion information storing means 6.

The X driver 16*a* outputs pulse signals for deleting, writing, addressing, scanning, sustaining, etc. based on the sustain frequency from the sustain frequency determining means , and the timing signal from the timing signal output circuit 18, and performs matrix display onto the display panel 20 according to the pulse signal for scanning outputted by the Y driver 19.

Figure 1:
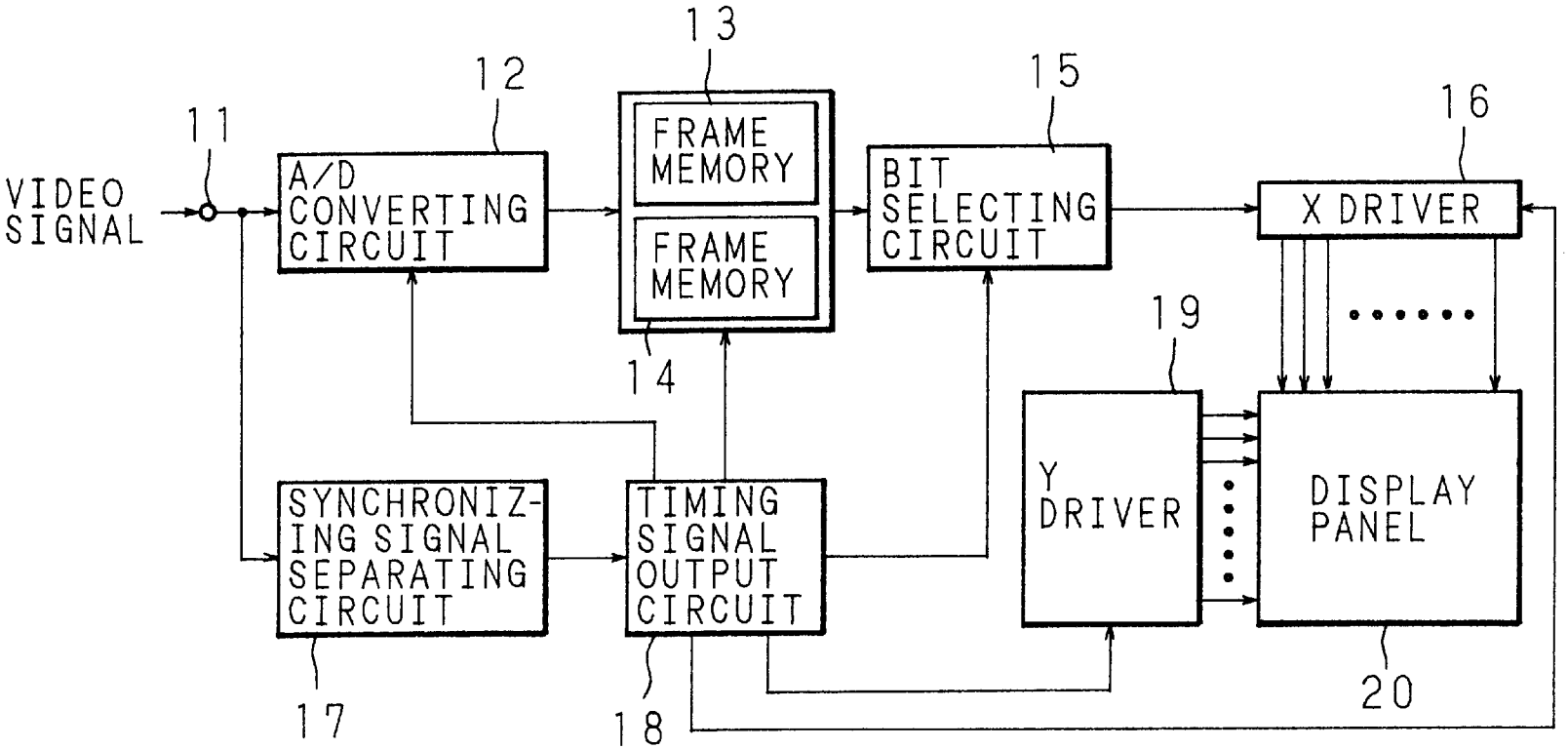
FIG. 1 PRIOR ART
FIG. 1 is a block diagram showing an example of an arrangement of a conventional image display apparatus.
Figure 2:
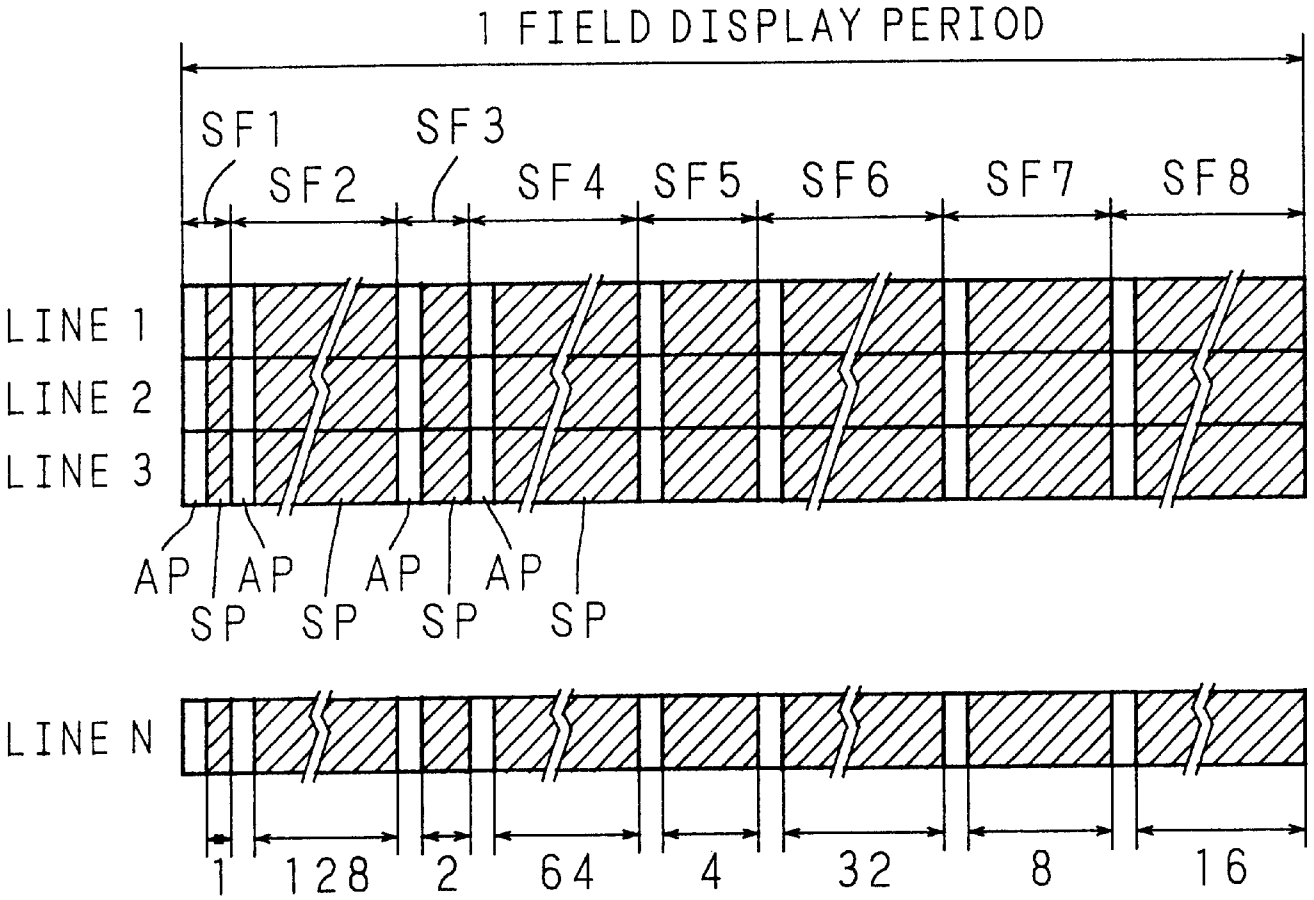
FIG. 2 PRIOR ART
FIG. 2 is an explanatory view for explaining a display operation of an image display apparatus.
Figure 3:
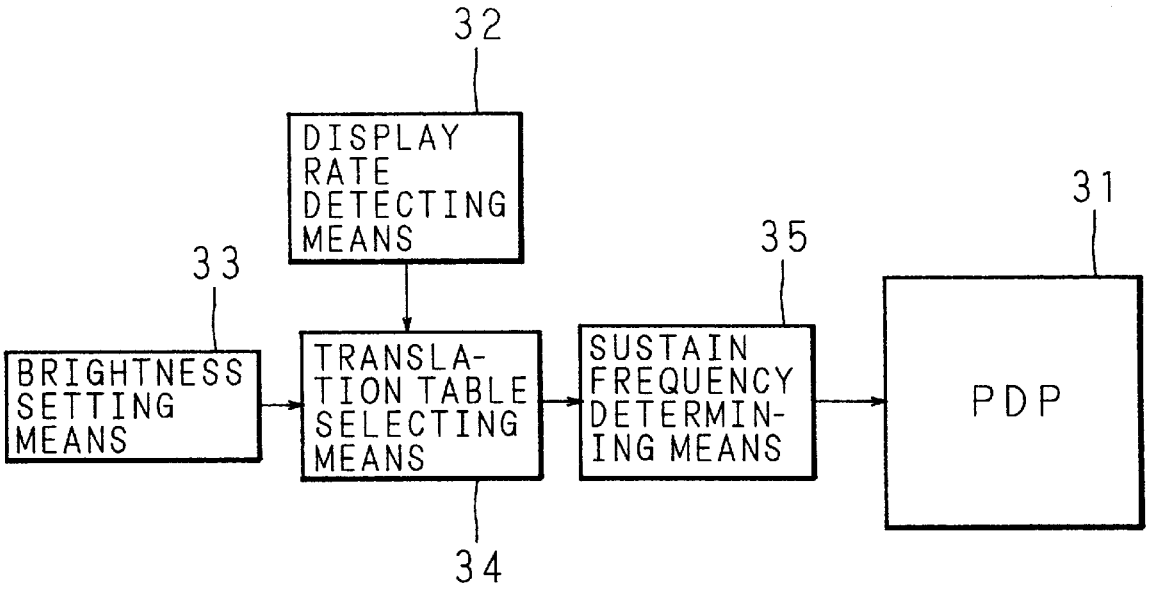
FIG. 3 PRIOR ART
FIG. 3 is a block diagram showing an example of an arrangement of another conventional image display apparatus.

For example, in the case of 8-bit gradation (256 gradations) display, as shown in FIG. 2, as for each pixel of the matrix display panel 20, one field period as one picture display period is divided into eight subfield periods SF1, SF2, . . . SF8, and the divided subfield periods SF1, SF2, . . . SF8 are further divided into addressing periods Al and display periods SP. The respective subfield periods SF1, SF2, . . . SF8 are weighted in proportion of 1:2:4: . . . :128, and for example, when a display pulse number (sustain pulse: pulse for sustaining plasma discharge) of weight per unit is two, respective display pulse numbers of the subfield periods SF1, SF2, . . . SF8 become two, four, eight, . . . 2536.

Since the display pulse number is approximately in proportion to luminous brightness, when subfield periods (for example, SF1, SF3 and SF5) are selected according to the luminous brightness from the eight subfield periods SF, SF2, . . . SF8, pixels can be lit for a time in which gradation display according to the luminous brightness in 256 gradations (for example, the eighth gradation display in 256-gradation display) can be obtained.

Here, the addressing periods AP of the respective subfield periods SF1, SF2, . . . SF8 are constant (for example, 1.5 ms) regardless of the subfield periods, and are determined according to a type of the display panel 20. In each addressing period AP of each subfield period, first writing is performed on the whole surface (all pixels) of the display panel 20, and deleting discharge takes place according to image data so that addressing is performed. In the display period SP next to the addressing period AP, as mentioned above, the pixels are lit or turned off for the time for weighting the subfield periods according to the display pulse number (sustain frequency).

Figure 5:
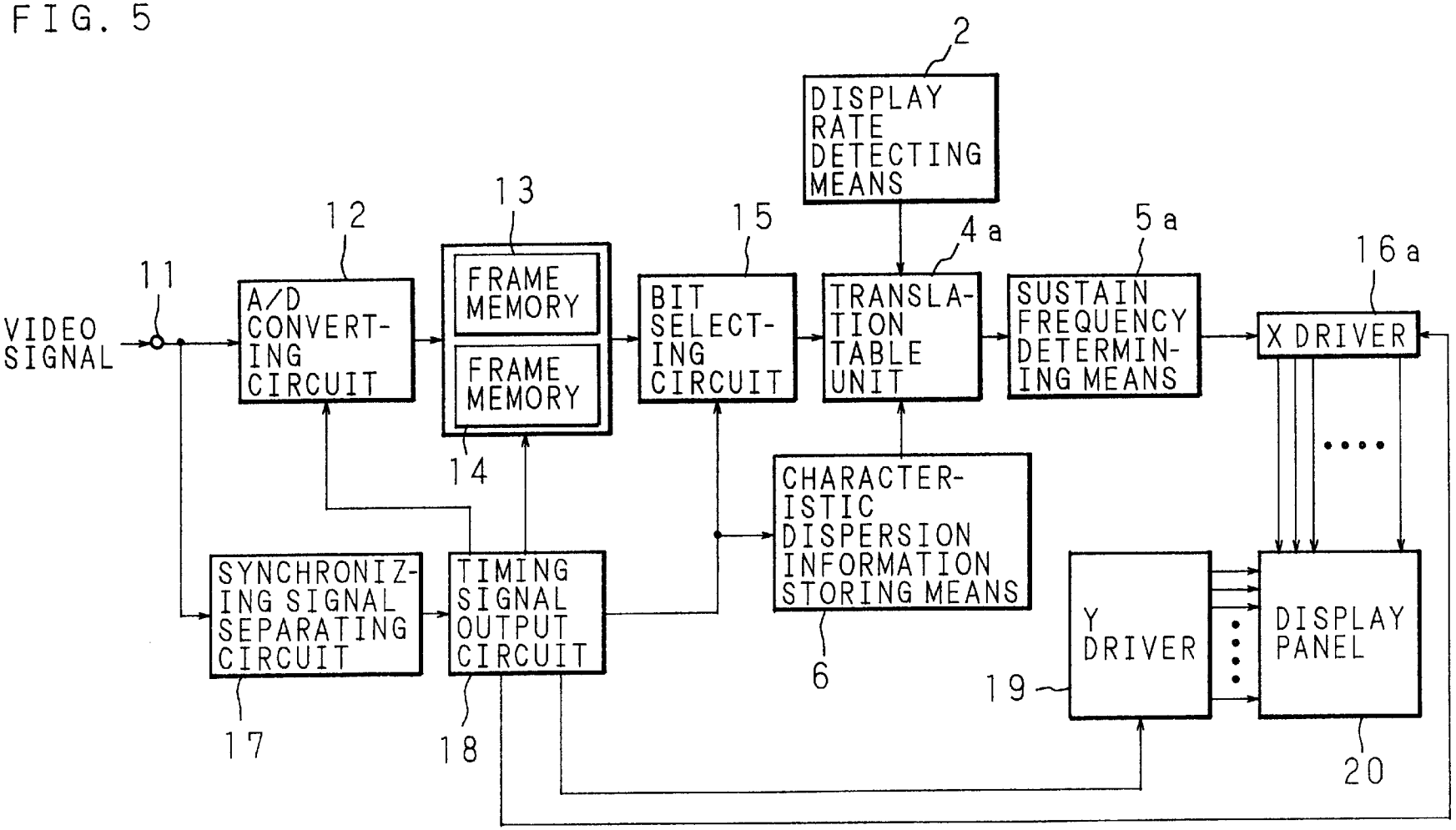
FIG. 5 is a block diagram showing another arrangement of the image display apparatus according to the first embodiment of the present invention.

Here, as shown in FIG. 5, the correction factor k stored in the characteristic dispersion information storing means 6 may be determined as data which are supplied to the translation table unit 4*a* (correcting means) and referred to thereby. Namely, data for determining the sustain frequency from the display rate DR and correction factor k are stored in the translation table unit 4*a*, and the sustain frequency determining means 5*a* determines and outputs the sustain frequency based on the data for determining the sustain frequency from the translation table unit 4*a*. The same effect can be obtained also in this case.

In addition, in the case where the characteristic dispersion information stored in the characteristic dispersion information storing means 6 is information representing brightness dispersion of the display device, the same effect can be obtained.

The dispersion information about the brightness of the display device is generated as follows and is stored in the characteristic dispersion information storing means 6. For example, just when production and assembly are completed, the image display apparatus is driven by the standard sustain frequency $f_0$, and brightness $B_1$ of the display device at that time is measured so that the measured brightness $B_1$ is compared with predetermined brightness $B_0$. When the measured brightness $B_1$ is larger than the predetermined brightness $B_0$ sustain frequency of the pixels is reduced so that sustain frequency $f_1$ in which the measured brightness $B_1$ coincides with the predetermined brightness $B_0$ is obtained. Moreover, when the measured brightness $B_1$ is smaller than the predetermined brightness $B_0$, the sustain frequency of the pixels is increased so that sustain frequency $f_1$* in which the measured brightness $B_1$ coincides with the predetermined brightness $B_0$ is obtained.

As a result, information per obtained pixel relating to $\Delta f=f_1$ (or $f_1$*)$-f_0$, for example, correction factor $p=f_1$ (or $f_1$*)$/f_0$ is calculated, and it is stored as dispersion information about the brightness of the display device into the characteristic dispersion information storing means 6.

The other arrangements and operations are the same as those in the case of the aforementioned power consumption, and as a result, the image display apparatus in which the brightness dispersion is small is realized.

[Second Embodiment]

Figure 6:
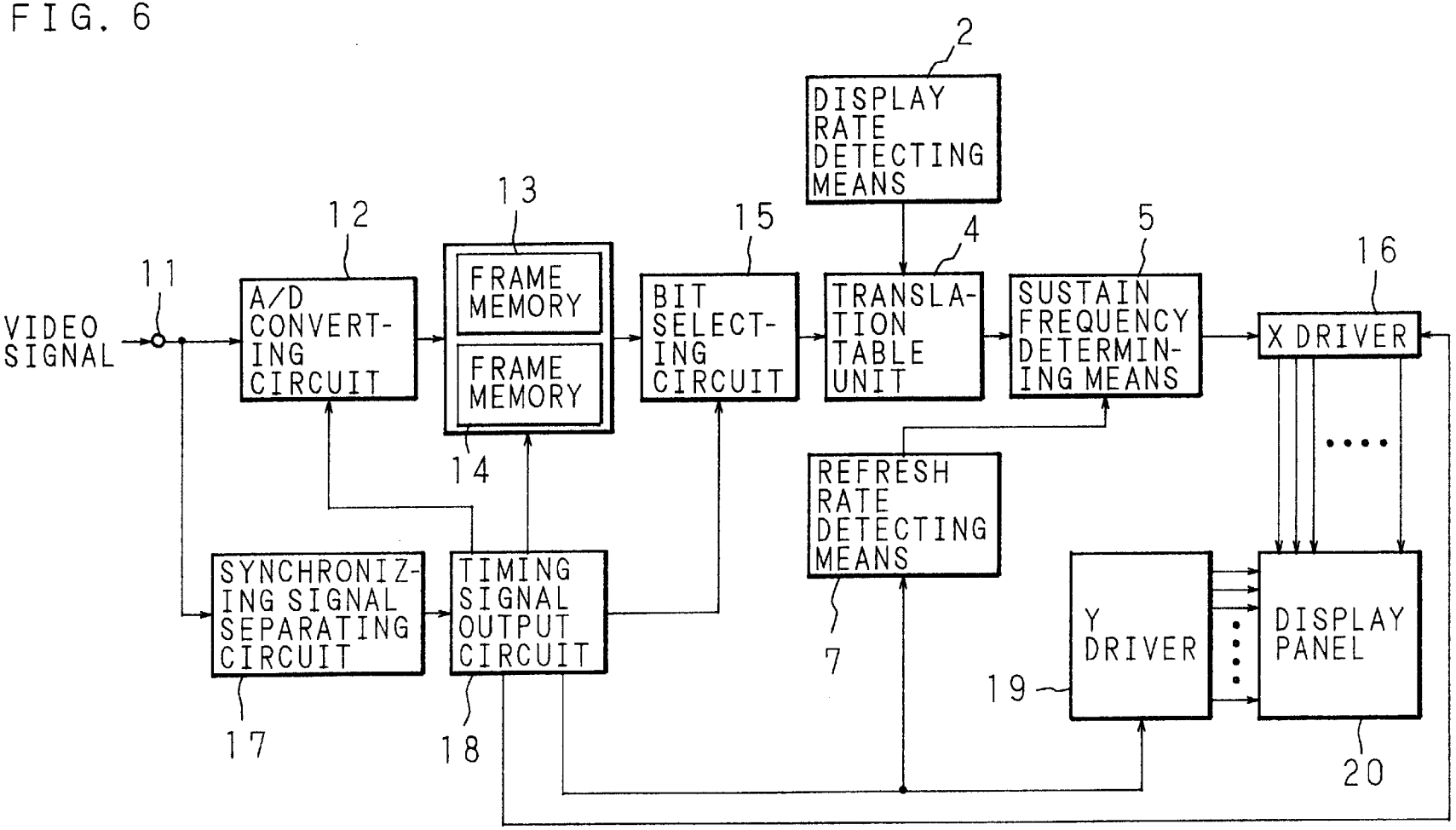
FIG. 6 is a block diagram showing an arrangement of the image display apparatus according to a second embodiment of the present invention.

FIG. 6 is a block diagram showing an arrangement of the image display apparatus according to the second embodiment of the present invention.

The image display apparatus according to the second embodiment of the present invention includes a matrix type display panel 20 which is PDP, an A/D converting circuit 12, frame memories 13 and 14 and a bit selecting circuit 15. The A/D converting circuit 12 converts a video signal inputted to a video signal input terminal 11 into a digital signal. The video signal which was converted into the digital signal by the A/D converting circuit 12 is written as image data alternately into the frame memories 13 and 14 per predetermined period (for example, 1/30sec or 1/60 sec which is one frame period). The bit selecting circuit 15 selects image data of pixels (bit) to be displayed from the image data read out alternately from the frame memories 13 and 14 and outputs the image data.

The image display apparatus according to the second embodiment of the present invention further includes display rate detecting means 2 and translation table unit 4. The display rate detecting means 2 detects a display rate DR (the ratio of the sum of values obtained by multiplying a number of pixels on the whole picture to be lit by the lighting time to the maximum value) on one display picture of the display panel 20 from the image data. The translation table unit 4 selects a translation table for correcting and translating brightness of the image data outputted by the bit selecting circuit 15 according to the display rate DR detected by the display rate detecting means 2 so that power consumption of the display panel 20 does not become excessive, and corrects and translates the brightness. The translation table unit 4 is made based on the display rate DR which is previously measured so that the power consumption of the display panel 20 does not become excessive.

The image display apparatus according to the second embodiment of the present invention further includes a synchronizing signal separating circuit 17, a timing signal output circuit 18, refresh rate detecting means 7 (detecting means) and sustain frequency determining means 5 (lighting controlling means and correcting means). The synchronizing signal separating circuit 17 separates a synchronizing signal (for example, horizontal synchronizing signal and vertical synchronizing signal) from the video signal inputted into the video signal input terminal 11. The timing signal output circuit 18 supplies a timing signal to the A/D converting circuit 12, the frame memories 13 and 14, the bit selecting circuit 1.5, the characteristic dispersion information storing means 6 and the other portions based on the synchronizing signal separated by the synchronizing signal separating circuit 17. The refresh rate detecting means 7 detects a refresh rate of a video signal, namely, a vertical synchronizing signal frequency based on the timing signal (vertical synchronizing signal) from the timing signal output circuit 18. The sustain frequency determining means 5 determines and outputs a display pulse number (sustain frequency) per pixel according to the brightness which was corrected and translated by the translation table unit 4 and the refresh rate detected by the refresh rate detecting means 7.

The image display apparatus according to the second embodiment of the present invention further includes an X driver 16*a* and a Y driver 19. The X driver 16*a* is supplied with the sustain frequency, which was determined and outputted by the sustain frequency determining means a, and the timing signal from the timing signal output circuit 18, and outputs pulse signals for deleting, writing, addressing, scanning, sustaining (discharge sustaining), etc. to the display panel 20. The Y driver 19 is supplied with the timing signal from the timing signal output circuit 18, and outputs the pulse signal for scanning to the display panel 20.

The following describes an operation of the image display apparatus according to the second embodiment of the present invention having the above arrangement.

The sustain frequency determining means 5 determines and outputs a display pulse number (sustain frequency) of pixels to be displayed based on the brightness of the pixels to be displayed which was outputted by the translation table unit 4 and the refresh rate detected by the refresh rate detecting means 7.

At this time, when detecting from the vertical synchronizing signal that, for example, the refresh rate is 75 Hz, the refresh rate detecting means 7 calculates a refresh rate correction factor $\gamma$=75 Hz/60 Hz so as to supply the refresh rate correction factor $\gamma$ to the sustain frequency determining means a. The sustain frequency determining means 5 multiplies the sustain frequency obtained from the brightness of the pixels to be displayed outputted by the translation table unit 4 by a reciprocal $1/\gamma$ of the refresh rate correction factor y given from the refresh rate detecting means 7 and determines final sustain frequency so as to supply it to the X driver 16*a*.

The X driver 16*a* outputs pulse signals for deleting, writing, addressing, scanning, sustaining, etc. based on the sustain frequency from the sustain frequency determining means 5 and the timing signal from the timing signal output circuit 18, and performs matrix display onto the display panel 20 according to the pulse signal for scanning outputted by the Y driver 19.

As a result, the power consumption of the display panel 20 can be maintained at a value obtained when the refresh rate is approximately 60 Hz. Therefore, the image display apparatus, which can reduce a change in the power consumption when the refresh rates are different, can be realized. Since the other operations are the same as those of the image display apparatus described in the first embodiment, the description thereof is omitted.

Figure 7:
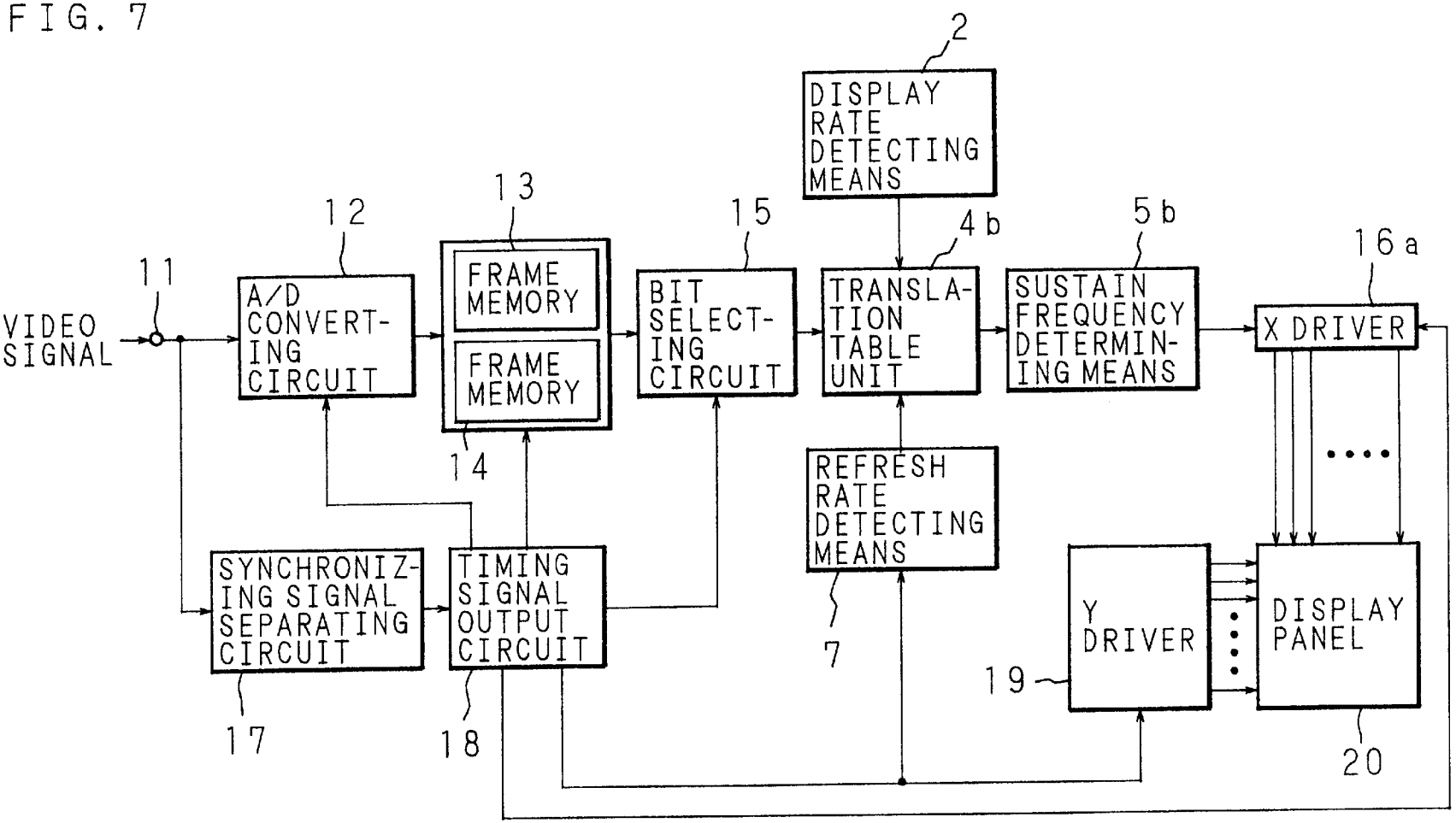
FIG. 7 is a block diagram showing another arrangement of the image display apparatus according to the second embodiment of the present invention.

As shown in FIG. 7, the refresh rate correction factor $\gamma$ calculated by the refresh rate detecting means 7 may be supplied to a translation table unit 4*b* (correcting means) and used as data which are referred by the translation table unit 4*b*. Namely, the data, which is used for determining the sustain frequency from the display rate DR on one display picture and the refresh rate correction factor $\gamma$, are stored in the translation table unit 4*b*, and the sustain frequency determining means 5*b* determines sustain frequency based on the data for determining the sustain frequency from the translation table unit 4*b* and outputs it. The same effect can be obtained also in this case.

The aforementioned first and second embodiments described the case where the display panel 20 (display unit) is PDP, but needless to say, the same effect is obtained also in the case of the display panel formed by LED).

As mentioned above, in the image display apparatus according to the first aspect, in order to display multiple-gradation image, the lighting controlling means controls the time for lighting the pixels of the display unit within a predetermined time, and the correcting means corrects the lighting time to be controlled. For this reason, even when the characteristic dispersion of the display device in the display unit is large, the characteristic dispersion between the image display apparatuses can be restrained.

In the image display apparatus according to the second aspect, the storing means stores dispersion information representing characteristic dispersion of the display device composing the display unit, and the correcting means corrects the lighting time based on the stored dispersion information. For this reason, even when the characteristic dispersion per pixel on the display unit is large, characteristic dispersion between the image display apparatuses can be restrained.

In the image display apparatus according to the third aspect, the storing means stores dispersion information representing dispersion of power consumption of the display device composing the display unit, and the correcting means corrects the lighting time based on the stored dispersion information about power consumption. For this reason, even when the characteristic dispersion of the power consumption per pixel of the display unit is large, the characteristic dispersion of the power consumption between the image display apparatuses can be restrained.

In the image display apparatus according to the fourth aspect, the storing means stores dispersion information representing dispersion of luminous brightness of the display device composing the display unit, and the correcting means corrects lighting time based on the stored dispersion information about the luminous brightness. For this reason, even when the characteristic dispersion of the luminous brightness per pixel on the display unit is large, the characteristic dispersion of the luminous brightness between the image display apparatuses can be restrained.

In the image display apparatus according to the fifth aspect, in order to display multiple-gradation image, the lighting controlling means controls a time for lighting pixels of the display unit within a predetermined time, and the detecting means detects a refresh rate of a video signal to be displayed. The correcting means corrects the lighting time controlled by the lighting controlling means based on the refresh rate detected by the detecting means. As a result, a change in power consumption due to the refresh rate of an input signal can be restrained.

Further, in the aforementioned aspects, since the display unit is a plasma display panel, even when the characteristic dispersion of the display device is large, characteristic dispersion between individual image display apparatuses can be restrained, or the change in power consumption due to the refresh rate of the input signal can be restrained.

Furthermore, in the aforementioned aspects, since the display unit is a display panel composed of light-emitting diode, even when the characteristic dispersion of the display device is large, the characteristic dispersion between the image display apparatuses can be restrained, or the change in power consumption due to the refresh rate of the input signal can be restrained.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image display apparatus, comprising:

a display unit having a plurality of pixels;

lighting controlling means for controlling a time for lighting the pixels within a predetermined time in order to display a multiple-gradation image;

detecting means for detecting a refresh rate of a video signal to be displayed; and correcting means for correcting the lighting time controlled by said lighting controlling means based on the refresh rate detected by said detecting means.

2. The image display apparatus as set forth in claim 1, wherein said correcting means determines a display pulse number of said pixels to be displayed based on the refresh rate, and corrects the lighting time in accordance with display pulse number.

3. The image display apparatus as set forth in claim 1, wherein said display unit is a plasma display panel.

4. The image display apparatus as set forth in claim 1, wherein said display unit is a display panel composed of light-emitting diode.

5. An image display apparatus, comprising:

a display unit having a plurality of pixels;

lighting controlling means for controlling a time for lighting the pixels in order to display a multiple-gradation image;

storing means for storing dispersion information previously measured representing characteristic dispersion of a display device of said display unit; and correcting means for correcting the lighting time controlled by said lighting controlling means based on the dispersion information stored in said storing means.

6. The image display apparatus as set forth in claim 5, wherein said correcting means determines a display pulse number of said pixels to be displayed based on the dispersion information and corrects the lighting time of said pixels in accordance with the display pulse number.

7. The image display apparatus as set forth in claim 6, further comprising:

a translation table for correcting the brightness of an image data based on a display rate and wherein said correcting means determines the display pulse number based on the dispersion information and the brightness of the image data.

8. The image display apparatus as set forth in claim 6, further comprising:

a translation table for storing data for determining the display pulse number based on a display rate and said dispersion information;

and wherein said correcting means determines the display pulse number based on the data from said translation table.

9. The image display apparatus as set forth in claim 6, further comprising:

a refresh rate detecting means for detecting a refresh rate of a video signal to be displayed;

and wherein said correcting means determines the display pulse number based on the dispersion information and said refresh rate.

10. The image display apparatus as set forth in claim 5, wherein the dispersion information stored in said storing means is information relating to dispersion of power consumption of said display unit due to the characteristic dispersion of said pixel.

11. The image display apparatus as set forth in claim 5, wherein the dispersion information stored in said storing means is information relating to dispersion of luminous brightness of said pixel.

12. The image display apparatus as set forth in claim 5, wherein said display unit is a plasma display panel.

13. The image display apparatus as set forth in claim 5, wherein said display unit is a light-emitting diode.

* * * * *